US009526325B2

(12) United States Patent
Hesse et al.

(10) Patent No.: US 9,526,325 B2
(45) Date of Patent: Dec. 27, 2016

(54) PAINT BRUSH AND MANUFACTURING METHOD

(75) Inventors: Bryan L. Hesse, Lake Bluff, IL (US); Jeffrey F. Taylor, Naperville, IL (US); Jason Carley, Chicago, IL (US); John White, Chicago, IL (US); Antonio Belton, Richton Park, IL (US)

(73) Assignee: Valspar Sourcing, Inc., Minneapolis, MN (US)

( * ) Notice: Subject to any disclaimer, the term of this patent is extended or adjusted under 35 U.S.C. 154(b) by 154 days.

(21) Appl. No.: 14/232,752

(22) PCT Filed: Jun. 22, 2012

(86) PCT No.: PCT/US2012/043728

§ 371 (c)(1),
(2), (4) Date: Jan. 14, 2014

(87) PCT Pub. No.: WO2013/012520

PCT Pub. Date: Jan. 24, 2013

(65) Prior Publication Data

US 2014/0140753 A1 May 22, 2014

Related U.S. Application Data

(60) Provisional application No. 61/509,048, filed on Jul. 18, 2011.

(51) Int. Cl.
*A46B 11/00* (2006.01)
*A46B 3/12* (2006.01)
(Continued)

(52) U.S. Cl.
CPC ..... *A46B 11/00* (2013.01); *A46B 3/12* (2013.01); *A46B 11/001* (2013.01); *A46B 17/06* (2013.01);
(Continued)

(58) Field of Classification Search
CPC ..... A46B 3/02; A46B 3/08; A46B 3/12; A46B 11/06; A46B 17/06; A46B 2200/202
(Continued)

(56) References Cited

U.S. PATENT DOCUMENTS 168,363 A 10/1875 Baker
1,065,610 A 6/1913 Hooker
(Continued)

FOREIGN PATENT DOCUMENTS

GB 2096888 A 10/1982
WO WO 2001/67920 A1 9/2001

OTHER PUBLICATIONS

International Preliminary Report on Patentability and Written Opinion, issued Jan. 21, 2014, Patent Application No. PCT/US2012/043728, filed Jun. 22, 2012; 7 pgs.
(Continued)

*Primary Examiner* — Jennifer C Chiang
*Assistant Examiner* — Bradley Oliver
(74) *Attorney, Agent, or Firm* — Mueting, Raasch & Gebhardt, P.A.

(57) ABSTRACT

A paint brush and method include a ferrule extending around and in contact with a plurality of bristles and a spacer apparatus positioned to space apart the plurality of bristles to provide at least one reservoir within the plurality of bristles. The spacer apparatus defines at least one opening extending through the spacer apparatus that allows fluid passage therethrough to the at least one reservoir to assist in removal of paint from the plurality of bristles when fluid is provided therein.

19 Claims, 14 Drawing Sheets

(51) Int. Cl.
*A46B 17/06* (2006.01)
*A46D 1/00* (2006.01)
*A46B 3/02* (2006.01)

(52) U.S. Cl.
CPC . *A46D 1/00* (2013.01); *A46B 3/02* (2013.01); *A46B 2200/202* (2013.01)

(58) Field of Classification Search
USPC ..... 401/286
See application file for complete search history.

(56) References Cited

U.S. PATENT DOCUMENTS 3,871,048 A * 3/1975 Leigh ..... A46B 3/12 15/193
4,525,890 A * 7/1985 Peerman ..... A46B 3/02 15/193
4,676,685 A * 6/1987 Murphy ..... A46B 11/063 401/279
4,790,679 A * 12/1988 Murphy ..... A46B 7/04 401/146
4,916,773 A 4/1990 McCoy
5,398,365 A 3/1995 MacKenzie
5,483,721 A 1/1996 Caldwell
5,483,723 A * 1/1996 Wenzer ..... A46B 9/02 15/159.1
5,904,434 A * 5/1999 Bekius ..... A46B 11/063 401/282
6,082,921 A 7/2000 Caldwell
6,213,667 B1 4/2001 Isaac
2008/0095571 A1 * 4/2008 Geigle ..... A46B 17/06 401/289

OTHER PUBLICATIONS

International Search Report, mailed Oct. 1, 2012, Patent Application No. PCT/US2012/043728, filed Jun. 22, 2012; 4 pgs.

* cited by examiner

PAINT BRUSH AND MANUFACTURING METHOD

CROSS-REFERENCE TO RELATED APPLICATIONS

This application is the §371 U.S. National Stage of International Application No. PCT/US2012/043728, filed 12 Jun. 2012, which claims the benefit of U.S. Provisional Application Ser. No. 61/509,048 filed 18 Jul. 2011, entitled "PAINT BRUSH AND METHOD REGARDING SAME," which are incorporated herein by reference in their entireties.

BACKGROUND

The present disclosure herein relates generally to paint brushes. More particularly, the disclosure herein pertains to paint brushes that are easier to clean.

Paint brushes may be cleaned in various ways. For example, brushes may be cleaned using water or solvent. In the case of latex paints, for example, brushes may be held in various positions under running water in an attempt to remove paint from the bristles.

Many paint brush configurations use one or more spacers to create a reservoir in the middle of bristles to hold paint such that the paint brush can effectively be used (e.g., paint is held in the reservoir when paint is applied to the bristles by a user and prior to the application of the paint to an object). Without an adequate reservoir, such brushes are generally not as effective.

However, often when a brush is cleaned, paint existing deep in bristles (e.g., such as in and around the reservoir) may not be completely removed. As such, the paint may later dry and harden, thus stiffen and reduce the flexibility of the brush making it undesirable for use in the future.

Various techniques have been described to address the problems with cleaning brushes. However, such techniques are inadequate for various reasons. For example, one or more of such techniques involve provision of an inadequate reservoir in the paint brush leading to ineffective painting and/or involve complex structure that increases the cost of such paint brushes.

SUMMARY

The disclosure herein relates generally to paint brushes and methods for making the same. Generally, the disclosure herein pertains to the use of a spacer (e.g., which defines an opening therethrough) that creates at least one reservoir in a plurality of bristles of a paint brush. The opening in the spacer is used as a fluid passageway to the at least one reservoir to assist in removal of paint from the plurality of bristles.

One exemplary embodiment of a paint brush may include a brush handle (e.g., a brush handle that includes a handle portion and an attachment portion) and a plurality of bristles extending from a distal bristle end region to a proximal bristle end region. The attachment portion of the brush handle defines at least one channel extending from a distal outlet opening to a proximal inlet opening located closer to the handle portion than the distal outlet opening. Further, the paint brush includes a ferrule extending around and in contact with at least a portion of the plurality of bristles at the proximal bristle end region (e.g., and, in one or more embodiments also may be coupled to at least a portion of the attachment portion), and a spacer apparatus extending from a proximal end to a distal end and positioned to space apart the plurality of bristles at the proximal bristle end region to provide at least one reservoir within the plurality of bristles (i.e., the spacer apparatus defines at least one opening extending through the spacer apparatus from the proximal end to the distal end). At least a portion of the plurality of bristles at the proximal bristle end region are coupled between the ferrule and the spacer apparatus. Further, the at least one channel of the attachment portion and the at least one opening of the spacer apparatus define a passageway that allows fluid passage from the proximal inlet opening of the attachment portion to the at least one reservoir to assist in removal of paint from the plurality of bristles when fluid is provided into the proximal inlet opening of the attachment portion.

In one or more embodiments of the paint brush, the ferrule may include at least one inner surface in contact with the plurality of bristles, and the spacer apparatus may include one or more inner surfaces adjacent the at least one opening and one or more outer surfaces facing the least one inner surface of the ferrule. For example, the one or more outer surfaces of the spacer apparatus and the at least one inner surface of the ferrule may define a bristle region within which the plurality of bristles are located.

Further, for example, in one or more embodiments of the paint brush, the paint brush may include one or more of the following features: an adhesive may be provided in the bristle region to couple the plurality of bristles at the proximal bristle end region to the ferrule and the spacer apparatus; an adhesive may seal the bristle region about the entire perimeter of the spacer apparatus between the one or more outer surfaces of the spacer apparatus and the at least one inner surface of the ferrule; the ferrule may extend from a distal end to a proximal end with the proximal end of the ferrule located closer to the handle portion than the proximal end of the spacer apparatus, and the proximal end of the spacer apparatus may be located closer to the handle portion than the proximal bristle end region; the spacer apparatus may be spaced from an inner surface of the ferrule by a plurality of spacing elements; the ferrule may include an inner surface in contact with the plurality of bristles with a plurality of grooves being defined in the inner surface; the ferrule may be a seamless ferrule; the at least one opening of the spacer apparatus may be configured to restrict the ingress of paint from the at least one reservoir into the at least one channel; and a plug portion configured to extend into the at least one opening of the spacer apparatus to selectably close the proximal inlet opening and remove material in the at least one opening when positioned therein.

Further, in one or more embodiments, the handle portion may define a void region proximate the proximal inlet opening to allow access thereto. For example, the handle portion may include an elongated handle member extending between a proximal end and a distal end and first and second spaced apart arm members coupling the distal end of the elongated handle member to first and second spaced apart portions of the attachment member (e.g., the void region being located between the first and second spaced apart members); the handle portion may include an elongated handle member extending between a proximal end and a distal end and a solid material handle body member extending from and coupling the distal end of the elongated handle member to and along a width of the attachment member (e.g., wherein the void region is located on at least one side of the solid material handle body member); or the handle portion may include an elongated handle member extending between a proximal end and a distal end and a single curved arm member coupling the distal end of the elongated handle member to a portion of the attachment member (e.g., wherein the void region is located between the proximal inlet opening and a portion of the single curved arm member).

An exemplary method of manufacturing a paint brush is also described. For example, the method may include: providing a plurality of bristles extending from a distal bristle end region to a proximal bristle end region; providing a ferrule extending from a proximal end to a distal end (e.g., wherein the ferrule defines a bristle opening); locating the plurality of bristles into the bristle opening of the ferrule; inserting a spacer apparatus within the proximal bristle end region of the plurality of bristles to space apart at least a portion of the plurality of bristles to provide at least one reservoir within the plurality of bristles (e.g., wherein the spacer apparatus defines a least one opening extending through the spacer apparatus from a proximal end to a distal end thereof); inserting a mandrel into the proximal end of the ferrule to configure the plurality of bristles; providing adhesive in a bristle region defined between the spacer apparatus and the ferrule to couple at least a portion of the plurality of bristles at the proximal bristle end region to the spacer apparatus and the ferrule; providing a brush handle (e.g., a brush handle that includes a handle portion and an attachment portion, wherein the attachment portion defines at least one channel extending from a distal outlet opening to a proximal inlet opening located closer to the handle portion than the distal outlet opening); and coupling the attachment portion of the brush handle and the ferrule such that the at least one channel of the attachment portion and the at least one opening of the spacer apparatus define a passageway that allows fluid passage from the proximal inlet opening of the attachment portion to the at least one reservoir to assist in removal of paint from the bristles when fluid is provided into the proximal inlet opening.

In one or more embodiments of the method, the method may include one or more of the following: providing adhesive in the bristle region about the entire perimeter of the spacer apparatus between one or more outer surfaces of the spacer apparatus and at least one inner surface of the ferrule; positioning the spacer apparatus such that the proximal end of the ferrule is located closer to the handle portion than the proximal end of the spacer apparatus and the proximal end of the spacer apparatus is located closer to the handle portion than the proximal bristle end region to create a channel for receiving the adhesive between the spacer apparatus and an inner surface of the ferrule; and using a plurality of spacing elements to space the spacer apparatus from an inner surface of the ferrule.

Still further, another exemplary paint brush may include a plurality of bristles extending from a distal bristle end region to a proximal bristle end region and a ferrule extending between a proximal end and a distal end (e.g., ferrule extending around and in contact with at least a portion of the plurality of bristles at the proximal bristle end region). Further, the paint brush may include a spacer apparatus extending from a proximal end to a distal end and positioned to space apart the plurality of bristles at the proximal bristle end region to provide at least one reservoir within the plurality of bristles (e.g., the spacer apparatus defines at least one opening extending through the spacer apparatus from the proximal end to the distal end). At least a portion of the plurality of bristles at the proximal bristle end region may be coupled between the ferrule and the spacer apparatus with the at least one opening of the spacer apparatus defining a passageway that allows fluid passage therethrough to the at least one reservoir to assist in removal of paint from the plurality of bristles when fluid is provided therein. Still further, a brush handle may be attachable (e.g., a detachable brush handle) at the proximal end of the ferrule.

The above summary is not intended to describe each embodiment or every implementation of the present disclosure. A more complete understanding will become apparent and appreciated by referring to the following detailed description and claims taken in conjunction with the accompanying drawings.

Figure 1:
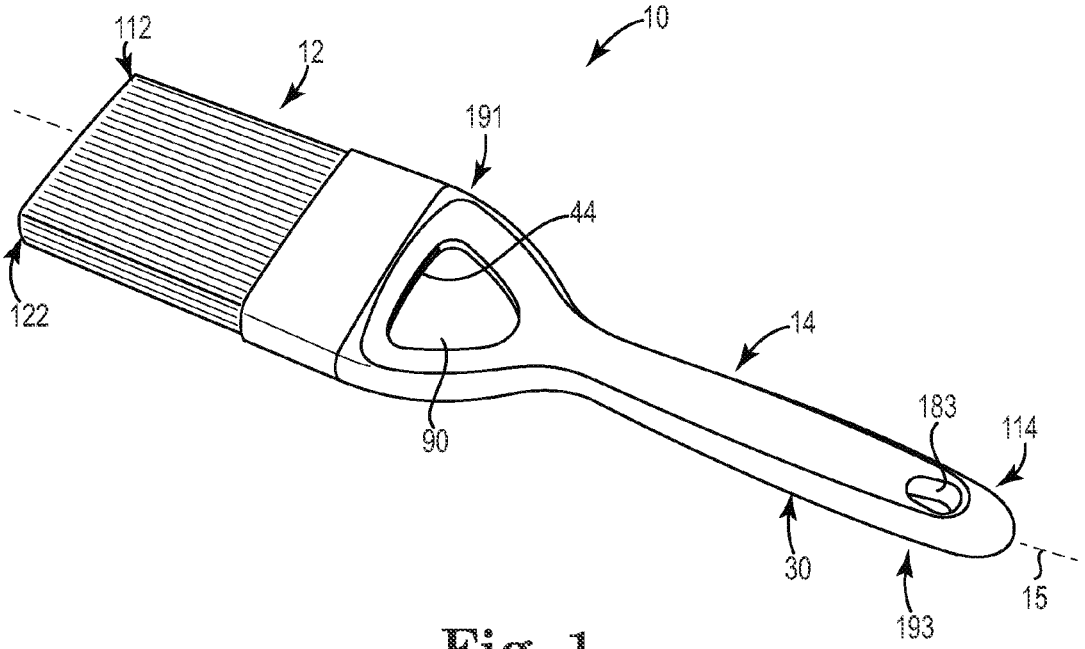
FIG. 1 is a perspective view of an exemplary embodiment of a paint brush.

The figures are rendered primarily for clarity and, as a result, are not necessarily drawn to scale.

DETAILED DESCRIPTION OF EXEMPLARY EMBODIMENTS

In the following detailed description of illustrative embodiments, reference is made to the accompanying figures of the drawing which form a part hereof, and in which are shown, by way of illustration, specific embodiments which may be practiced. It is to be understood that other embodiments may be utilized and structural changes may be made without departing from (e.g., still falling within) the scope of the disclosure presented hereby.

Exemplary paint brushes and methods regarding such paint brushes (e.g., methods of manufacturing or use thereof) shall generally be described with reference to FIGS. 1-8. It will be apparent to one skilled in the art that elements from one embodiment may be used in combination with elements of the other embodiments, and that the possible adapter apparatus embodiments using features set forth herein is not limited to the specific embodiments described. Further, it will be recognized that the embodiments described herein will include many elements that are not necessarily shown to scale. Further, it will be recognized that the size and shape of various elements herein may be modified without departing from the scope of the present disclosure, although one or more shapes and sizes may be advantageous over others.

FIG. 1 is a perspective view of a paint brush 10 extending along axis 15 from a distal bristle end portion 112 (e.g., including the ends of the bristles) to a proximal handle end 114 (e.g., including a handle member for the user to grasp).

The paint brush 10 includes a bristle portion 12 extending along axis 15 coupled to a brush handle 14 that also extends along axis 15. It will be recognized that the bristle portion 12, brush handle 14, and components thereof, need not be centered or symmetrical with respect to axis 15. For example, the brush handle 14 may include an attachment portion attached to the bristle portion 12 that is symmetrical to the axis 15, but include a handle portion that is not centered or symmetrical on the axis 15.

Figure 2:
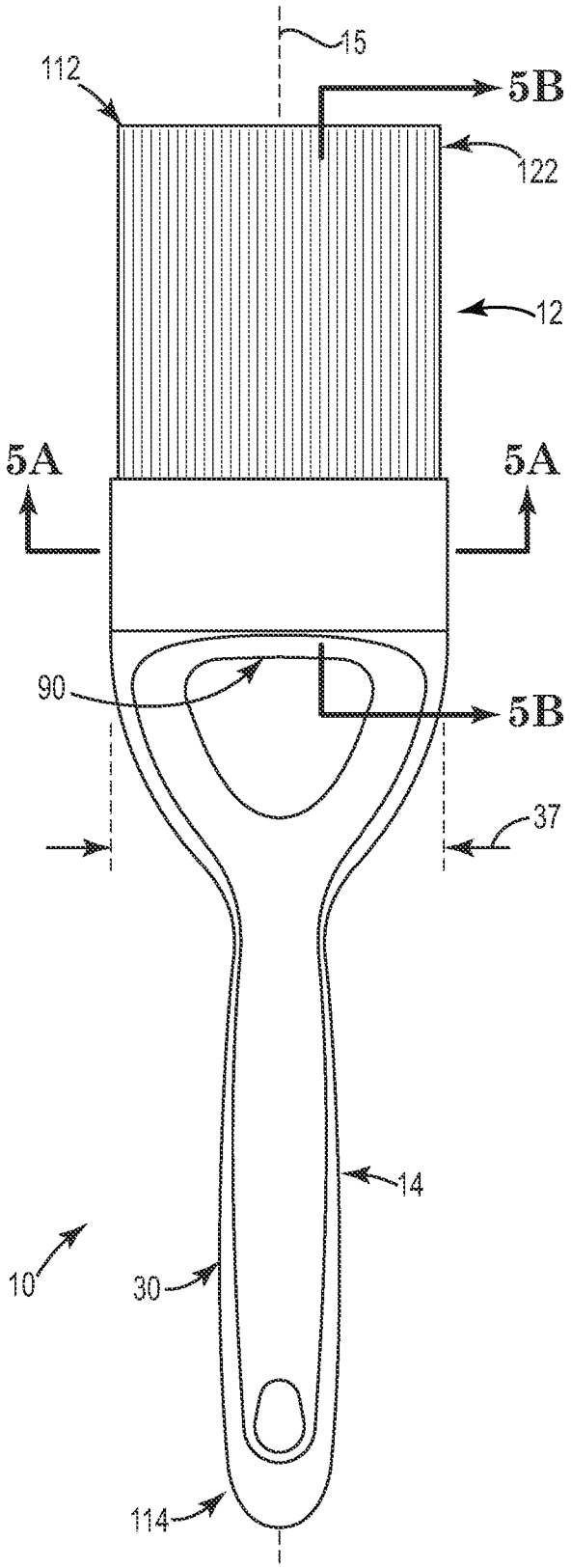
FIG. 2 is a plan view of the paint brush of FIG. 1.
Figure 3:
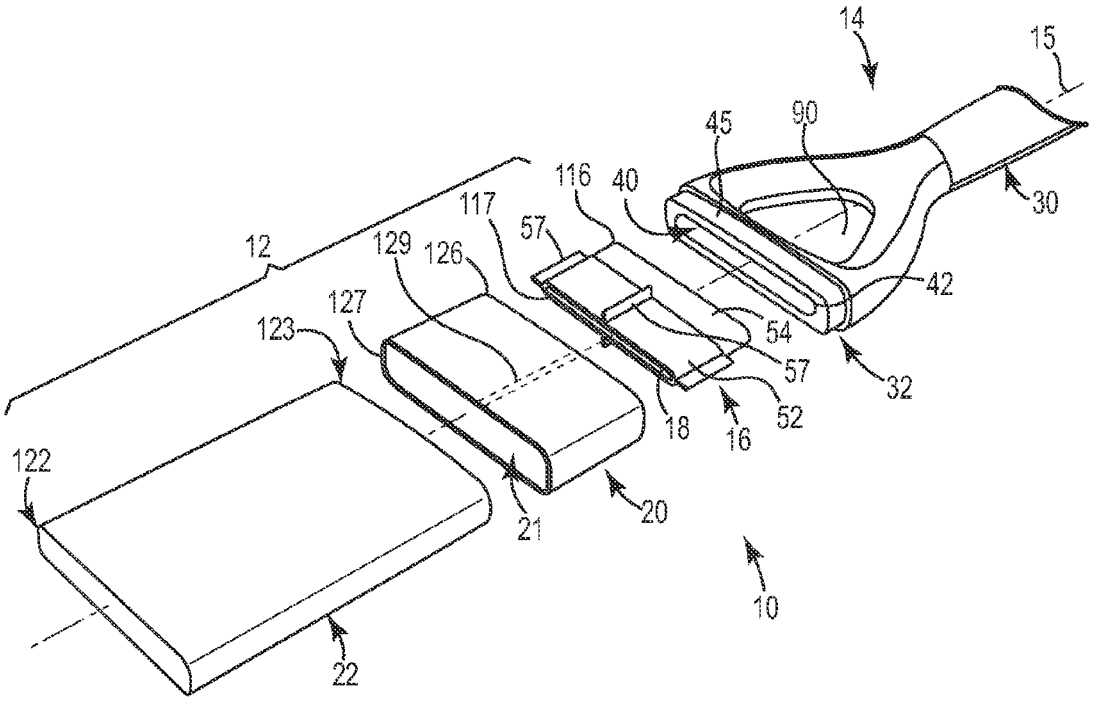
FIG. 3 is an exploded partial perspective view of the paint brush of FIG. 1.
Figure 4:
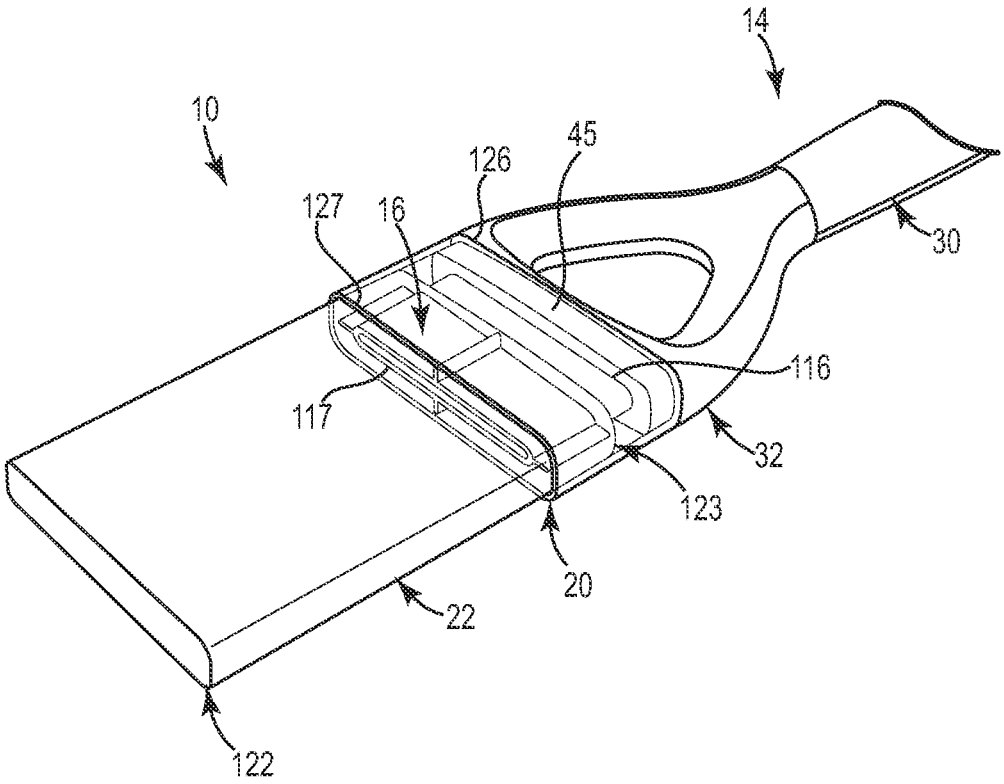
FIG. 4 is a transparent partial perspective view of the paint brush of FIG. 1.
Figure 5A:
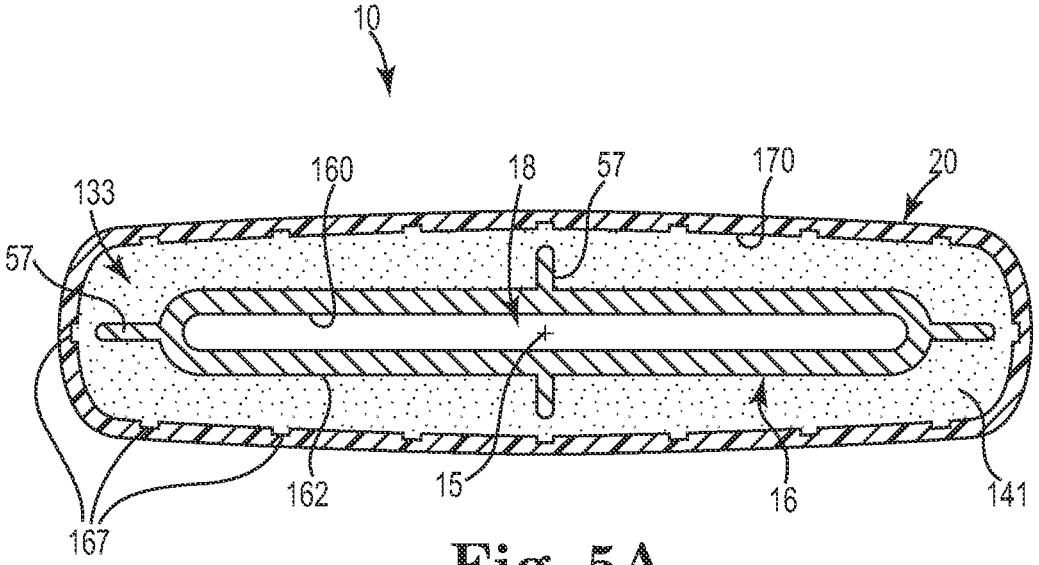
FIG. 5A is a cross section view of the paint brush of FIG. 1 taken along line 5A-5A of FIG. 2.
Figure 5B:
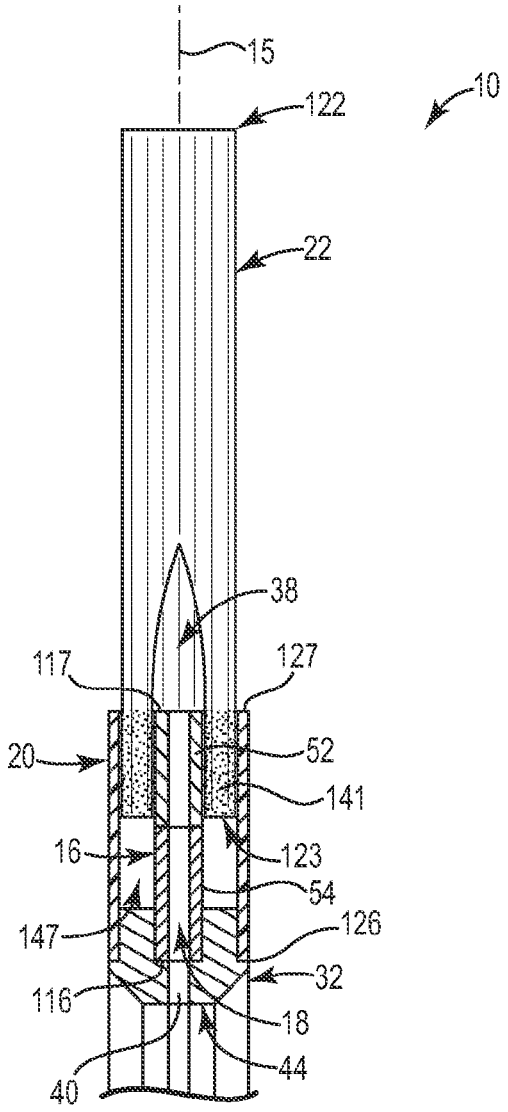
FIG. 5B is a cross section view of the paint brush of FIG. 1 taken along line 5B-5B of FIG. 2.

FIG. 2 is a plan view of the paint brush 10, FIG. 3 is an exploded partial perspective view of the paint brush 10, FIG. 4 is a transparent partial perspective view of the paint brush 10, and FIG. 5 (including both FIGS. 5A and 5B) show cross section views of the paint brush 10. As shown in FIGS. 1-5, the bristle portion 12 coupled to the brush handle 14 of the exemplary paint brush 10 includes a spacer apparatus 16, a ferrule 20, and a plurality of bristles 22.

Generally, the spacer apparatus 16 creates at least one reservoir 38 in the plurality of bristles 22 (see, e.g., FIG. 5B) of the paint brush 10. Further, generally, the spacer apparatus 16 defines an opening 18 therethrough that is used as a fluid passageway to the at least one reservoir 38 to assist in removal of paint from the plurality of bristles (e.g., for ease in cleaning the paint brush 10).

Further, generally, the plurality of bristles 22 extend from a distal bristle end region 122 to a proximal bristle end region 123 with the ferrule 20 extending around and in contact with at least a portion of the plurality of bristles 22 at the proximal bristle end region 123. The spacer apparatus 16 is positioned to space apart the plurality of bristles 22 at the proximal bristle end region 123 to provide the at least one reservoir 38 within the plurality of bristles 22. At least a portion of the plurality of bristles 22 at the proximal bristle end region 123 are coupled (e.g., using an adhesive, such epoxy) between the ferrule 20 and the spacer apparatus 18.

As shown in FIGS. 1-5, the brush handle 14 of the paint brush 10 may include a handle portion 30 and an attachment portion 32. In at least one embodiment, the attachment portion 32 of the brush handle 14 defines at least one channel 40 extending from a distal outlet opening 42 to a proximal inlet opening 44 located closer to the handle portion 30 than the distal outlet opening 42. In such an exemplary configuration, the ferrule 20 extends around and in contact with at least a portion of the plurality of bristles 22 at the proximal bristle end region 123. Further, for example, in one or more embodiments, the ferrule may also be coupled to at least a portion of the attachment portion 32 or, in other embodiments, the ferrule may be provided as a part of the handle. As such, the at least one channel 40 of the attachment portion 32 and the at least one opening 18 of the spacer apparatus 16 define a passageway that allows fluid passage from the proximal inlet opening 44 of the attachment portion 32 to the at least one reservoir 38 (e.g., via the at least one opening 18 of the spacer apparatus 16) to assist in removal of paint from the plurality of bristles 22 when fluid is provided into the proximal inlet opening 44 of the attachment portion 32. For example, the proximal inlet opening 44 may be held under a faucet by a user causing a flow of water through the passageway to clean the bristles 22, the brush 10 may be dip in a bucket of water and removed causing a flow of water through the passageway to clean the bristles 22, etc.

In one exemplary embodiment, the spacer apparatus 16 extends from a proximal end 116 to a distal end 117 along the axis 15. Further, the spacer apparatus 16 may include one or more inner surfaces 160 adjacent the at least one opening 18 and one or more outer surfaces 162 (e.g., facing an inner surface 170 of the ferrule 20 when assembled).

In one exemplary embodiment, the ferrule 20 extends from a proximal end 126 to a distal end 127. Further, the ferrule 20 includes at least one inner surface 170 that defines a bristle opening 21 therethrough (e.g., for receiving the plurality of bristles 22 therein when assembled). At least in one embodiment, the one or more outer surfaces 162 of the spacer apparatus 16 and the at least one inner surface 170 of the ferrule 20 define a bristle region 133 (see, e.g., FIG. 5A) within which the plurality of bristles 22 are positioned when assembled. For example, an adhesive 141 may be provided in the bristle region 133 to couple the plurality of bristles 22 at the proximal bristle end region 123 to the ferrule 20 (e.g., the at least one inner surface 170 thereof) and the spacer apparatus 16 (e.g., the one or more outer surfaces 162 thereof).

The plurality of bristles 22 (e.g., any number of filaments or bristles) may be formed of any suitable material for painting and the present disclosure is not limited to any particular type of bristles. For example, such bristles 22 may be formed of synthetic filaments such as nylon or any other materials, ox ear hair, horse hair, boar's hair, etc.

The ferrule 20 (e.g., centered along axis 15) which can be grasped by a user when painting may be formed of any suitable material. For example, in one or more embodiments, the ferrule 20 may be formed of at least one of plastic, one or more metals (e.g., stainless steel, plated aluminum, plated steel, etc.), cardboard, paper film, adhesive tape, wood, etc.). Further, the ferrule may be an extruded part, a stamped part, molded part, or machined part. For example, the ferrule 20 may be a seamless ferrule (e.g., formed by extrusion). Further, the ferrule 20 may be formed of one or more components with one or more seams. For example, the ferrule 20 may be a single component (e.g., stamped aluminum) formed (e.g., folded) to receive the plurality of bristles (e.g., either before or after insertion therein) with a seam (e.g., parallel to axis 15 extending from the proximal end 126 to the distal end 127) as shown by dashed line 129 in FIG. 3, or the ferrule 20 may be formed of multiple components (e.g., stamped aluminum) to receive the plurality of bristles (e.g., formed either before or after insertion therein) with one or more seams that form a single unitary ferrule component defining the bristle opening 21 along axis 15 (e.g., two or more components clamped together with the bristles in between).

The bristle opening 21 of the ferrule 20 extending along the axis 15 from the proximal end 126 to the distal end 127 is elongated in a direction orthogonal to the axis 15 (which generally defines the width 37 of the paint brush 10 as shown in FIG. 2, which may also be referred to herein as the maximum width of the paint brush 10). Such a paint brush 10 may be of various sizes (e.g., 1 inch, 1.5 inches, 2 inches, 2.5 inches, 3 inches, 4 inches, etc.) corresponding to the width of the ferrule 20. Further, the brush, and as such, the bristle opening (or shape of the bristles or other components of the brush such as the ferrule or spacer apparatus) could be of any other shape or size (e.g., circular, such as one including bristles that extend to a tapered end from the circular pattern of bristles; square, such as one that terminates in more square shaped tapered bristle ends, etc.). The present disclosure is not limited to only a rectangular shaped brush configuration or any other shape or size described herein.

In one or more embodiments, the at least one inner surface 170 of the ferrule 20 in contact with the plurality of bristles 22 when assembled includes a plurality of grooves 167 defined therein (see, e.g., FIG. 5A). Such grooves 167 may be defined with any spacing about the inner surface 170 of the ferrule 20 and in any suitable shape. For example, such grooves may be provided during an extrusion process or may be otherwise physically formed therein (e.g., material removal or forming processes such as etching, stamping, grinding, machining, etc.).

Such grooves 167 may provide one or more benefits in one or more embodiments of the paint brush 10. For example, as shown in FIG. 5A, adhesive 141 in the bristle region 133 between the ferrule 20 and the spacer apparatus 16 may not be present at the distal end 127 of the ferrule 20. With grooves 167 extending to the distal end 127, or with grooves only defined at the distal end 127 in the inner surface 170, fluid may travel into such grooves 167 between the inner surface 170 of the ferrule 20 and the plurality of bristles 22 therein to assist in cleaning the paint brush 10 from the distal side of the brush 10 (e.g., the brush may be dipped into water or solvent with such fluid travelling into the bristles through the grooves 167). As such, fluid may be assisted in its flow at the outside of the plurality of bristles 22 adjacent the ferrule 20 as well as proximate the at least one reservoir 38 defined within the bristles 22.

Further, such grooves 167 when provided at least towards the proximal end 126 of the ferrule may be used to enhance the bonding in the bristle region 133 between the ferrule 20 and the plurality of bristles 22. For example, in such embodiments, the grooves may be finer grooves about the inner surface 170 or may be any surface texturing suitable to provide such enhanced bonding to the plurality of bristles 22 adjacent the ferrule 20.

The spacer apparatus 16 (e.g., centered along axis 15) which provides for the formation of the at least one reservoir 38 to provide a quality paint brush 10 (e.g., a paint brush that holds in the reservoir and releases from the reservoir a sufficient quantity of paint, which prevents skipping or minimizes brush marks, which ensures laying down adequate layer of paint, etc.), and which also defines the at least one opening 18 for fluid flow therethrough to the at least one reservoir 38 to assist in cleaning the plurality of bristles 22, may be formed of any suitable material. For example, in one or more embodiments, the spacer apparatus 16 may be formed of at least one of plastic, one or more metals, wood, composite, foam, ceramic, etc. Further, the spacer apparatus may be an extruded part, a molded part, a machined part, a cut part, etc.

In one or more embodiments, the ferrule 20 and the spacer apparatus 16 (e.g., including any spacing elements therebetween) may be formed as an integral component. For example, such a component may be formed by extrusion. Still further, the brush handle (or one or more portions thereof, such as the attachment portion) may be formed integrally with the ferrule (e.g., a single brush handle and ferrule component). Still further, the ferrule, or parts thereof, could be formed as a part of the brush handle and the bristles coupled in the ferrule thereof (e.g., such as by clamping two ferrule and handle portion structures together about a plurality of bristles). Still further, any of the spacer, ferrule, attachment portion, and even the handle portion (or portions thereof) may be integrally formed together as a single piece or may be formed separately (e.g., the ferrule may be formed as part of the brush handle.

Further, in one or more embodiments, the spacer apparatus 16 may include one spacer component for creating a single reservoir in the plurality of bristles 22 or may include multiple spacer components that create multiple reservoirs in the plurality of bristles 22. For example, as shown in FIGS. 3-5, the spacer apparatus 16 is a spacer component extending along the axis 15 from the proximal end 116 to the distal end 117 and is elongated in a direction orthogonal to the axis 15 that creates a single reservoir 38 in the plurality of bristles 22 proximate the distal end 117 of the spacer apparatus 16. In such a configuration, the spacer apparatus 16 may define the opening 18 as a narrow opening from the proximal end 116 to the distal end 117 which is also elongated in a direction orthogonal to the axis 15. In one or more embodiments, the narrow opening 18 defined by the spacer apparatus 16 may have a length in the direction orthogonal to the axis 15 that is at least 30 percent, 40 percent, 50 percent, or 60 percent of the maximum width of the paint brush. One will recognize that due to structural limitations in smaller brushes (e.g., a one inch brush), that such a percentage of channel length versus brush width may be at the lower end. However, for larger width brushes, it may be advantageous that the narrow opening 18 be at least 50 percent of the maximum width of the brush 10 to create a wider fluid opening into the bristles 22 along a substantial portion of the width of the brush 10.

Similarly, for example, a paint brush may include multiple spacer components (e.g., similar to that shown in FIGS. 3-5) that create multiple reservoirs in the plurality of bristles 22. Such spacer components may be stacked along the thickness of the brush (e.g., parallel to the narrow opening 18) and separated by at least a portion of the bristles 22, and/or, for example, such spacer components may be positioned side by side within the bristles to create multiple reservoirs. Any configuration of multiple spacer components that create multiple reservoirs (e.g., separated by bristles) may be used (e.g., such as in larger size brushes). Further, one or more of such multiple spacer components may include an opening extending therethrough for providing the enhanced cleaning functionality described herein.

Further, in one or more embodiments, the spacer apparatus 16 may be formed of one or more components (e.g., along the axis 15). For example, as will be described herein with respect to one or more manufacturing methods for the paint brush 10, such components of the spacer apparatus 16 may include a primary spacer component 52 and an extension component 54. For example, primary spacer component 52 may be used to spread or space apart the plurality of bristles 22 to form the at least one reservoir 38 and an extension component 54 may be used to extend the primary spacer 52 such that the proximal end 116 is adjacent to, or coupled with the brush handle 14 (e.g., lies along axis 15 within the at least one channel 40 defined in the brush handle 14).

Further, for example, in one or more embodiments, the spacer apparatus 16 may be configured to restrict paint in the at least one reservoir from breaching (e.g., flow past) the proximal end 116 of the spacer apparatus 16 (e.g., when a user is painting a ceiling and holding the brush with bristles upward). For example, the spacer apparatus 16 or the at least one opening 18 defined therethrough may be configured to restrict the flow of paint within the at least one opening 18 and/or keep the paint from breaching or flowing past the proximal end 116 of the spacer apparatus 16. For example, in one or more embodiments, the opening 18 may be defined as a narrow opening having a gap dimension that prevents paint (e.g., due to the paint's viscosity) from entering the narrow opening or at least prevents the flow of paint from exiting the opening at the proximal end 116 of the spacer apparatus. Further, for example, a plurality of openings may be formed through the spacer apparatus (e.g., a structure defining small openings, such as a honeycomb structure or a mesh or screen structure, lying orthogonal to axis 15) that prevents the flow of paint from exiting the opening at the proximal end 116 of the spacer apparatus. Further, for example, in one or more embodiments, the spacer apparatus 16 may be configured with a one way valve (e.g., a duck bill valve, a flap, etc.) extending from or provided within the apparatus to prevent paint from entering the opening 18 or at least prevents the flow of paint from exiting the opening at the proximal end 116 of the spacer apparatus 16.

In one or more embodiments, the opening 18 at the distal end 117 of the spacer apparatus 16 may be configured to function as part of the at least one reservoir 38 but still prevent the flow of paint from exiting the opening at the proximal end 116 of the spacer apparatus 16. As such, the opening 18 may add additional reservoir space to provide more paint holding capacity for a user of the paint brush 10 which may provide additional quality benefits. For example, restriction structure may be located more proximally in the opening 18 of the spacer apparatus 16 to provide for such additional reservoir capacity, the opening 18 may be of a larger dimension at the distal end 117 versus the proximal end 116 to provide a receiving capacity for paint.

Still further, in one or more embodiments, the spacer apparatus 16 may be spaced from the inner surface 170 of the ferrule 20 by a plurality of spacing elements such as fins 57 or any other structure that provides a spacing function (e.g., a structure that allows bristles to be located in the bristle region). For example, such spacing elements (e.g., pins, fins, radially extending elements, etc.) may extend radially between the outer surface 162 of the spacer apparatus 16 and the inner surface 170 of the ferrule 20. The spacing elements (such as fins 57) may be formed as part of the spacer apparatus 16, may be formed as part of the ferrule 20, or may be a separate component or one or more components formed and/or used for such spacing purposes. The spacing elements assist in maintaining dimensions of the bristle region 133 and/or the spacing of the bristles 22 when the paint brush 10 is being assembled (e.g., the spacing elements may also mate with openings or grooves 167). Further, for example, the spacing of such spacing elements (e.g., fins 57) about the perimeter of the spacing apparatus 16 may vary and any suitable spacing size and shape may be used. In at least one embodiment, fins 57 are positioned symmetrically about the axis 15 and extending radially from the outer surface 162 of the spacer apparatus 16 as shown in FIGS. 3-5 (e.g., two opposing fins at the ends of the elongated spacer apparatus 16 and two opposing fins at the mid-point of the elongated spacer apparatus 16). Further, in at least one embodiment, the spacing elements 57 may be provided as a single spacing element extending radially along a plane orthogonal to axis 15 between the outer surface 162 of the spacing apparatus 16 and the inner surface 170 of the ferrule 20.

Further, in one or more embodiments, the one or more outer surfaces 162 of the spacer apparatus 16 may be configured to enhance the bonding in the bristle region 133 between the spacing apparatus 16 and the plurality of bristles 22. For example, in such embodiments, the outer surface 162 may be grooved or include any surface texturing suitable to provide such enhanced bonding to the plurality of bristles 22 adjacent the spacer apparatus 16.

As shown in FIGS. 5A-5B, adhesive 141 is used to couple (e.g., attach, connect, fix) the plurality of bristles 22 in the bristle region 133 between the one or more outer surfaces 162 of the spacer apparatus 16 and the at least one inner surface 170 of the ferrule 20. However, the bristles may be coupled in the bristle region by mechanical force between the ferrule 20 and the spacer apparatus 16 (e.g., by a clamping force). Further, for example, the adhesive 141 may be any curable adhesive (e.g., heat curable, chemically cured, etc.) suitable to accomplish such coupling. For example, the adhesive 141 may be an epoxy. Further, for example, in at least one embodiment, the adhesive 141 is sufficiently flowable to provide self-leveling when provided within a channel 147 created in the bristle region 133 by the spacer apparatus 16 and ferrule 20. Further, for example, in one or more embodiments, the adhesive 141 is non-reactive with paints and/or one or more cleaning fluids (e.g., water, solvents, etc.).

In one or more embodiments, the adhesive 141 may seal the bristle region 133 about the entire perimeter of the spacer apparatus 16 as shown in FIG. 5A between the one or more outer surfaces 162 of the spacer apparatus 16 and the at least one inner surface 170 of the ferrule 20. In such a manner, any fluid provided in the opening 18 at the proximal end of the spacer apparatus 16 can only flow through the opening 18 as the region about the perimeter is entirely sealed.

Still further, for example, in one or more embodiments as shown in FIG. 5B, the proximal end 126 of the ferrule 20 is located closer to the handle portion 30 of the brush handle 14 than the proximal end 116 of the spacer apparatus 16, and the proximal end 116 of the spacer apparatus 16 may be located closer to the handle portion 30 than the proximal bristle end region 123 of the plurality of bristles 22. In such a configuration, a channel 147 is created into which adhesive 141 may be provided and in which the adhesive 141 may flow to couple the plurality of bristles 22 at the proximal bristle end region 123 to the ferrule 20 and spacer apparatus 16. Further, in at least one embodiment, the proximal end 126 of the ferrule 20 need not be located closer to the handle portion 30 of the brush handle 14 than the proximal end 116 of the spacer apparatus 16, but need only be located closer to the handle portion 30 than the proximal bristle end region 123 for formation of the channel 147.

Still further, in at least one embodiment, the length of the spacer apparatus 16 along the axis 15 from the proximal end 116 to the distal end 117 may be such that the proximal end 117 thereof mates within a channel 40 formed in the brush handle 14. In such a configuration, the proximal end 116 of the spacer apparatus 16 may be located closer to the handle portion 30 of the brush handle 14 than the proximal end 126 of the ferrule 20, or they may extend the same distance, or the proximal end 126 of the ferrule 20 may be located closer to the handle portion 30 of the brush handle 14 than the proximal end 116 of the spacer apparatus 16 and still provide mating with the channel 40 (e.g., depending on the configuration of the structure defining the channel 40).

As shown in FIGS. 1-4, the brush handle 14 extends along axis 15 from a distal end portion 191 (e.g., including the attachment portion 32) to a more proximal end portion 193 (e.g., including the handle portion 30). The attachment portion 32 of the brush handle 14 may be configured in any manner suitable for coupling to the ferrule 20 (or any other portion of the bristle portion 12). For example, as shown in FIGS. 1-4, the attachment portion 32 includes an outer surface 45 extending along the axis 15 about the perimeter thereof that mates with the inner surface 170 of the ferrule 20. Such surfaces may be coupled in any manner, such as with adhesive, mechanical fastening including interference fits, fasteners (e.g., screws, rivets, nails, etc.), etc.

As described herein, the attachment portion 32 of the brush handle 14 may define at least one channel 40 extending from the distal outlet opening 42 to the proximal inlet opening 44 located closer to the handle portion 30 than the distal outlet opening 42. In one embodiment as shown in FIGS. 3-4, the distal outlet opening 42 is provided such that it mates with the spacer apparatus 16 (e.g., the proximal end 116 of spacer apparatus 16 fits within the at least one channel 40 and/or is sealed therein) to provide the passageway that allows fluid passage from the proximal inlet opening 44 of the attachment portion 32 to the at least one reservoir 38 (e.g., via the at least one opening 18 of the spacer apparatus 16) to assist in removal of paint from the plurality of bristles 22 when fluid is provided into the proximal inlet opening 44 of the attachment portion 32.

The attachment portion 32 (e.g., centered along axis 15 as shown in FIGS. 1-4) defines the at least one channel 40 for fluid flow therethrough to the at least one reservoir 38 to assist in cleaning the plurality of bristles 22. The attachment portion 32 may be formed of any suitable material. For example, in one or more embodiments, the attachment portion, as well as the handle portion 30, may be formed of at least one of plastic, one or more metals, wood, composites, cork, engineered materials (e.g., material formed from recycled material formed with adhesive), etc. Further, the attachment portion 32, as well as the handle portion 30, may be an extruded part, a molded part, a machined part, a cut part, a part formed by one or more wood fabrication techniques, etc.

In one or more embodiments, the attachment portion 32 and the handle portion 30 may be formed as an integral single component. In one or more other embodiments, the attachment portion 32 and the handle portion 30 may be formed of multiple components coupled together by any suitable means (e.g., adhesives, mechanical fasteners, etc.).

Further, in one or more embodiments, the attachment portion 32 may define more than one channel for receiving fluid to assist in cleaning the paint brush 10. For example, the attachment portion 32 may be configured to create multiple channels that feed into the at least one opening 18 of spacer apparatus 16, may be configured to create multiple channels that feed into multiple openings of the spacing apparatus 16, etc.

Any configuration of such channels may be used. For example, a channel from one side of a brush may be used in addition to a channel from a different side of the brush (e.g., both may flow into the same opening defined by the spacer apparatus 16 or different openings). Further, for example, multiple channels may be created side by side and/or in parallel to one another, or in any other suitable manner to provide flow of fluid for assisting in cleaning the bristles of the paint brush.

Further, for example, as shown in the exemplary embodiment of FIGS. 3-5, the attachment portion 32 extends along the axis 15 from the distal outlet opening 42 to the proximal inlet opening 44 and is elongated in a direction orthogonal to the axis 15. In such a configuration, the attachment portion 32 may define the channel 18 as a narrow channel that extends along the axis 15 from the distal outlet opening 42 to the proximal inlet opening 44 which is also elongated in a direction orthogonal to the axis 15. In one or more embodiments, the narrow channel 40 (like the narrow opening 18) defined by the attachment portion 32 may have a length in the direction orthogonal to the axis 15 that is at least 30 percent, 40 percent, 50 percent, or 60 percent of the maximum width of the paint brush. One will recognize that due to structural limitations in smaller brushes (e.g., a one inch brush), that such a percentage of channel length versus brush width may be at the lower end. However, for larger width brushes, it may be advantageous that the narrow channel 40 be at least 50 percent of the maximum width of the brush 10 to create a wider fluid opening into the bristles 22 along a substantial portion of the width of the brush 10.

Further, in one or more embodiments, the attachment portion 32 may be configured to restrict paint from breaching (e.g., flow past) the proximal inlet opening 44 of the attachment portion 32. For example, the attachment portion 32 or the at least one channel 40 defined therethrough may be configured to restrict the flow of paint within the at least at least one channel 40 and/or keep the paint from breaching or flowing past the proximal inlet opening 44 (e.g., such as when the brush is held with the bristles being upward). For example, in one or more embodiments, the channel 40 may be defined as a narrow channel having a gap dimension that prevents paint from entering the narrow channel or at least prevents the flow of paint from exiting the channel at the proximal inlet opening 44. Further, for example, a plurality of openings may be formed through the attachment portion 32 (e.g., a structure defining small openings, such as a honeycomb structure or a mesh or screen structure, lying orthogonal to axis 15) that prevents the flow of paint from exiting the proximal inlet opening. Further, for example, in one or more embodiments, the attachment portion 32 may be configured with a one way valve (e.g., a duck bill valve, flap, etc.) extending from or provided within the attachment portion 32 to prevent paint from entering the channel 40 or at least prevent the flow of paint from exiting the opening at the proximal inlet opening 44.

Figure 5C:
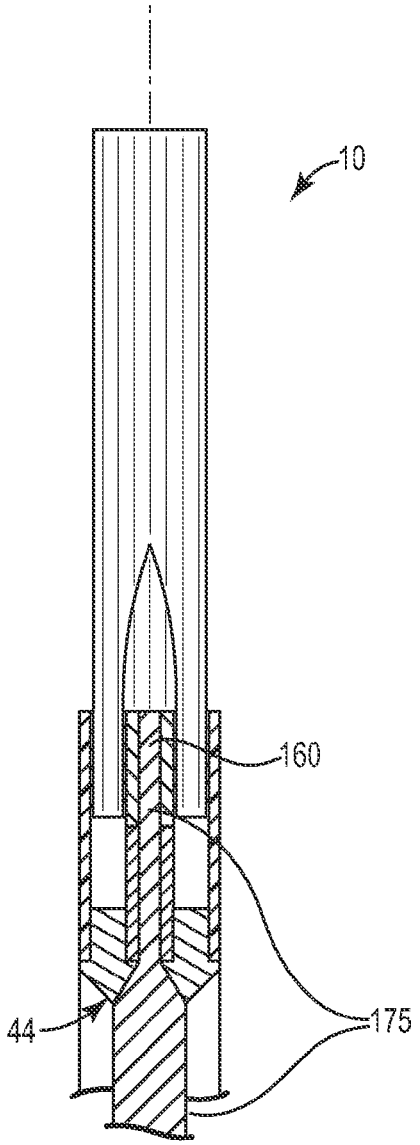
FIG. 5C is a cross section view of the paint brush of FIG. 1 taken along line 5B-5B of FIG. 2 with a plug portion provided for use therewith.

In one or more embodiments, a plug portion 175 (shown in FIG. 5C but usable with any brush embodiment described herein) may be configured to selectably close the proximal inlet opening 44 to prevent the flow of paint from exiting the opening at the proximal inlet opening 44. For example, in one embodiment, the plug portion 175 may be formed to be inserted not only within the channel 40 defined through of the attachment portion 32 but also to be inserted in the at least one opening 18 of the spacer apparatus 16 as shown in FIG. 5C. In such a manner, the insertion into the opening 18 may remove material in the at least one opening 18 (e.g., paint, wet or dry, that may be residing therein). For example, the plug portion 175 may be sized relative to inner surface 160 of the spacer apparatus 16 such that it pushes any dry paint along the inner surface 160 of the spacer apparatus 16 and into the at least one reservoir such that it can be washed away during cleaning. Further, in one or more embodiments, the plug portion 175 need not extend into the channel 18 and may not even extend into the channel 40 of the attachment portion 32. For example, the plug portion may take the form of a tape plug just covering the proximal inlet opening 44 and removable when cleaning of the brush is desired, the plug portion may be dissolvable (e.g., dissolve when water is provided on the plug such that it need not be pulled from the opening 44), etc.

Further, in one or more embodiments, the handle portion 30 may define a void region 90 proximate the proximal inlet opening 44 to allow access thereto such that fluid may be provided into the passageway for assisting in cleaning the bristles 22 of the paint brush 10. The void region 90 may be created by any one or more configurations of the handle portion 30 and connection thereof to the attachment portion 32, and the present disclosure is not limited to those shown or described herein. For example, various alternate handle portions are shown and described herein with reference to FIG. 1 and FIGS. 6A-6C.

Figure 6A:
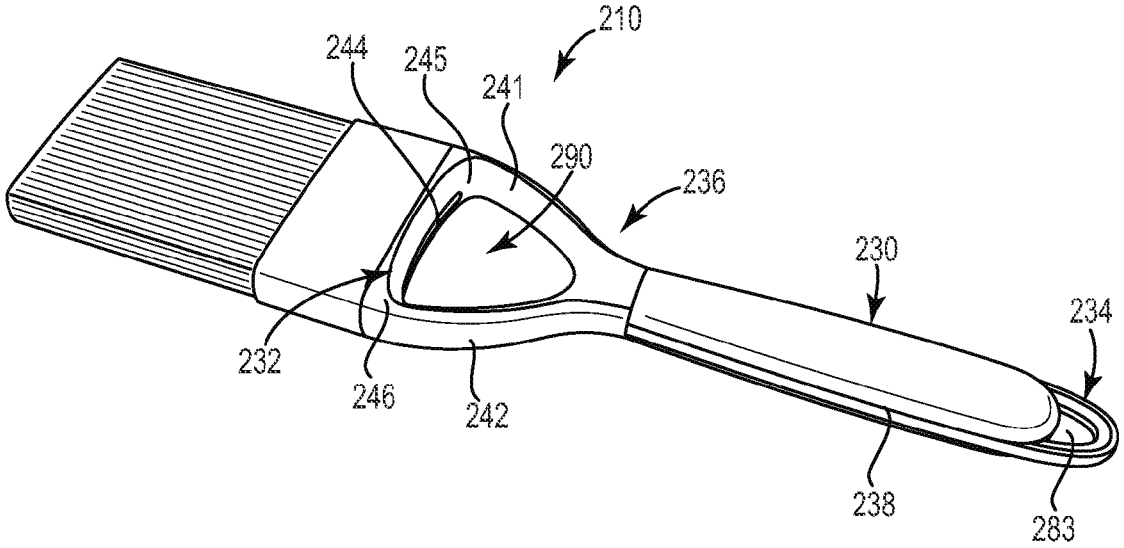
FIGS. 6A-6C are perspective view of alternative paint brushes.

For example, FIGS. 1 and 6A show a similar handle portion. The primary difference between the paint brush 10 of FIG. 1 and the brush 210 shown in FIG. 6A is that the handle portion 30 of paint brush 10 includes an integral hanging opening 183 defined therein while the handle portion 230 of FIG. 6A includes a multiple component handle portion, wherein a hanging opening 283 is defined by the coupling of the components.

As such, the handle portion 230 of paint brush 210 shall be described in further detail, but such components are similar to those of paint brush 10. For example, the handle portion 230 includes an elongated handle member 238 extending between a proximal end 234 (e.g., proximate the hanging opening 283) and a distal end 236. The handle portion 230 further includes first and second spaced apart arm members 241-242 coupling the distal end 236 of the elongated handle member 238 to first and second spaced apart portions 245-246 of the attachment member 232. The void region 290 for access to the proximal inlet opening 244 defined in the attachment portion 232 is located between the first and second spaced apart members 214, 242. As such, fluid may be easily provided to the proximal inlet opening 244. As shown in FIGS. 1 and 6A, this creates a "Y" type handle configuration. One will also note that the arm members 241-241 are somewhat thicker than the arm members of the handle portion 30.

Figure 6B:
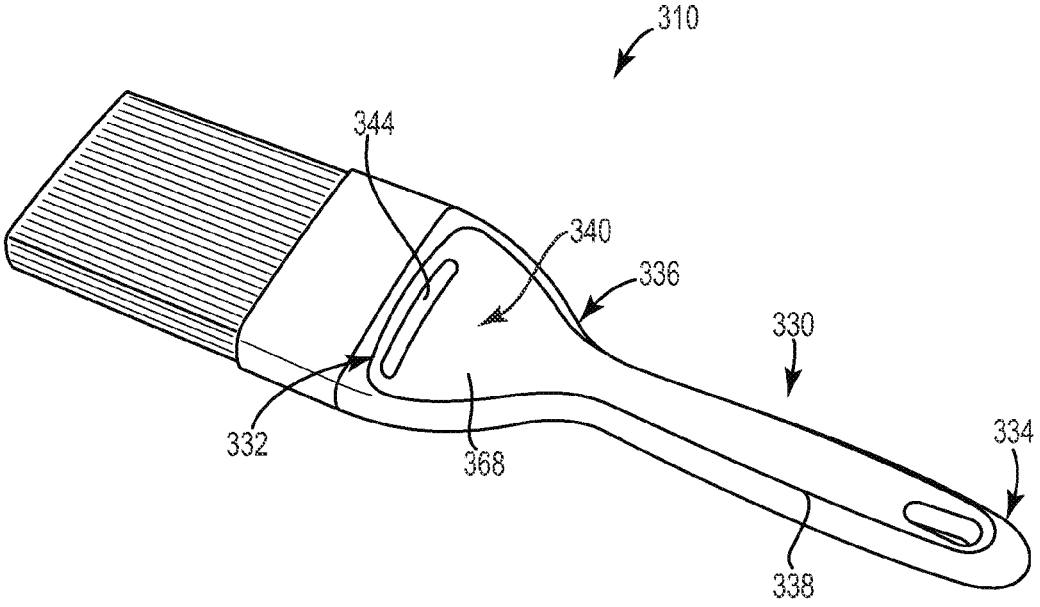

In another embodiment, as shown in FIG. 6B, the handle portion may be configured in a more solid configuration (e.g., without an opening completely through the handle proximate proximal inlet opening 344). For example, the handle portion 330 of paint brush 310 may include an elongated handle member 338 extending between a proximal end 334 and a distal end 336. A solid material handle body member 368 extends from and couples the distal end 336 of the elongated handle member 338 to and along a width of the attachment member 332. In this configuration, a void region 340 is located on one side of the solid material handle body member 368. In an alternate configuration, another proximal inlet opening may be provided on the other side of the paint brush 310 with another void region created to provide flow of fluid thereto for cleaning purposes. In other words, the alternate embodiment may include another side opposite that shown in FIG. 6B and which is a mirror image thereof.

Figure 6C:
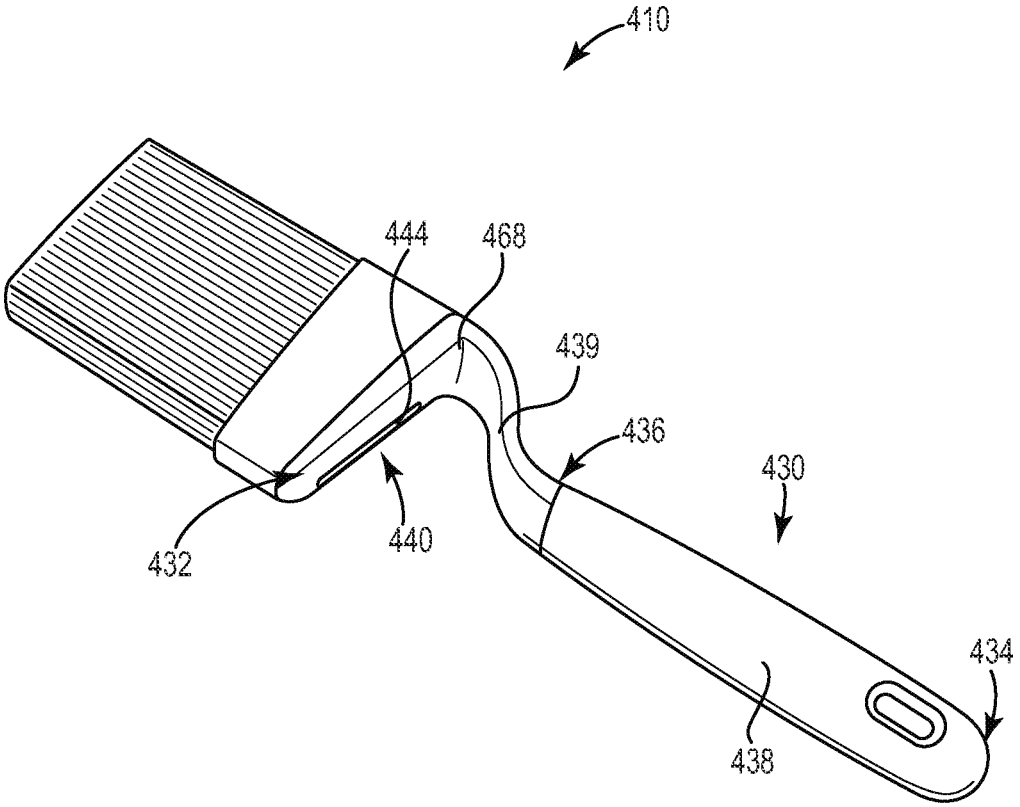

In another embodiment, as shown in FIG. 6C, the handle portion may be configured in a lazy "S" configuration. For example, the handle portion 430 of paint brush 410 may include an elongated handle member 438 extending between a proximal end 434 and a distal end 436. A single curved arm member 439 couples the distal end 436 of the elongated handle member 432 to a portion 468 of the attachment member 432. A void region 440 is located between the proximal inlet opening 444 and a portion of the single curved arm member 439.

In one or more embodiments, the brush handle 14 is an attachable brush handle that may be removed from the bristle portion 12 such that the bristle portion 12 may be cleaned separately (e.g., fluid may be provided into the bristle portion 12). In such a configuration, the attachment portion 32 may not be provided with a channel 40 defined therethrough as fluid may be provided directly into the at least one opening 18 of the spacer apparatus 16 when the bristle portion 12 is removed from the brush handle 14.

For example, in one or more embodiments, the brush handle 14 may be removably coupled to or detachable from the bristle portion 12 by an interference fit between the outer surface 45 of the attachment portion 32 and the inner surface 170 of the ferrule 20 (e.g., the ferrule may be a rubber ferrule that is tightly secured to the outer surface 45, but removable therefrom by a pulling action). Further, for example, in one or more embodiments, additional structure may be used to lock and unlock the bristle portion 12 to the brush handle 14. For example, releasable claws (e.g., latchable mechanism) may be used to retain the bristle portion 12 on the brush handle 14, releasable fasteners may be used for such purposes, latches may be used, snaps may be used, removable pins may be used, etc.

Figure 7A:
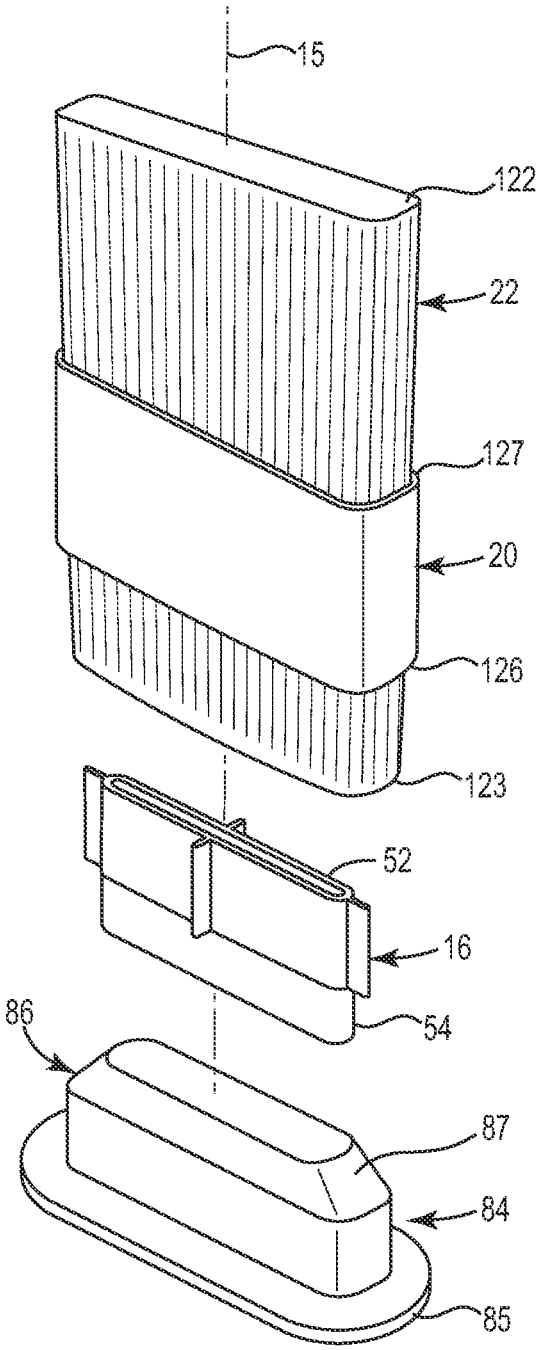
FIGS. 7A-7E are perspective views for illustrating one exemplary embodiment of making a paint brush such as that shown in FIG. 1.
Figure 7B:
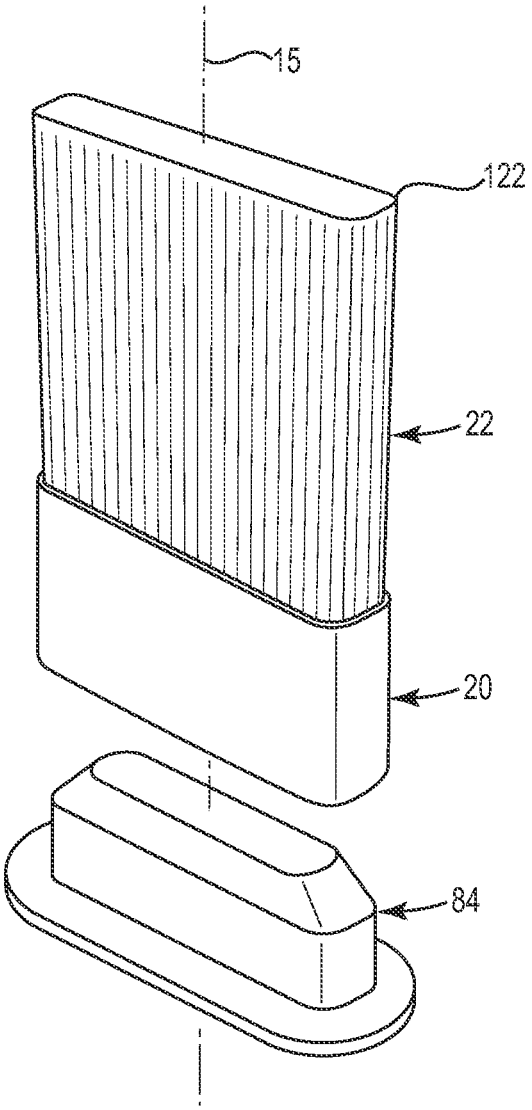
Figure 7C:
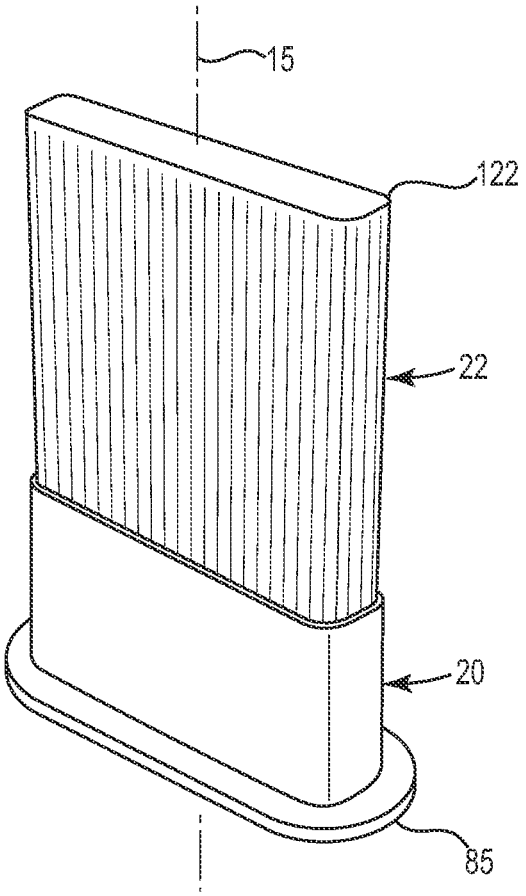
Figure 7D:
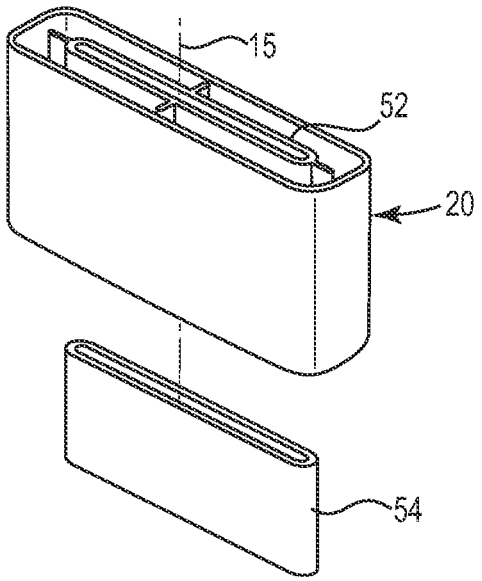
Figure 7E:
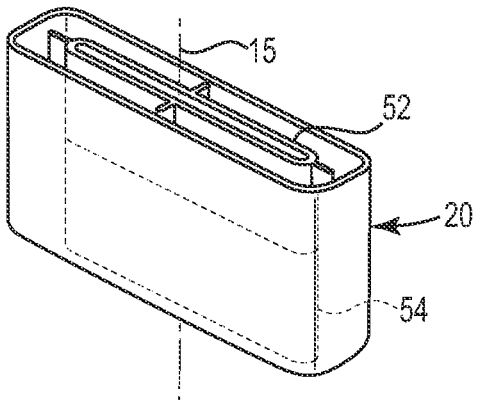
Figure 8:
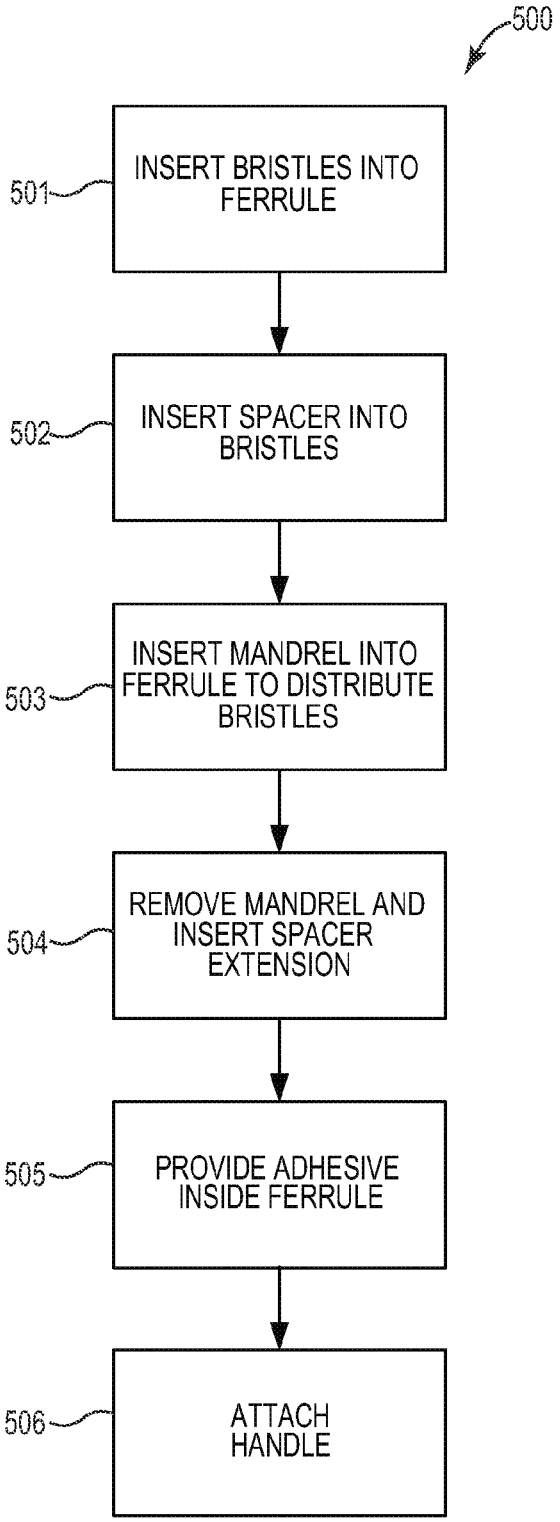
FIG. 8 is a flow chart illustrating one exemplary embodiment of making a paint brush such as that shown in FIG. 1.

An exemplary method of manufacturing a paint brush 10 (such as shown in FIGS. 1-5 and whose reference numbers will be used to describe such a method) shall be described with respect to FIGS. 7A-7E, as well as the flow diagram of FIG. 8. The method 500 may include providing a plurality of bristles 22 extending from a distal bristle end region 122 to a proximal bristle end region 123 and providing a ferrule 20 extending from a proximal end 126 to a distal end 127 (e.g., wherein the ferrule defines a bristle opening 21). The plurality of bristles 22 are located or inserted into the bristle opening 21 of the ferrule 20 (block 501) as shown in FIG. 7A.

Further, the method 500 includes inserting (e.g., from either end of the bristles) a spacer apparatus 16 within the proximal bristle end region 123 of the plurality of bristles 22 to space apart at least a portion of the plurality of bristles 22 to provide at least one reservoir 38 within the plurality of bristles 22 (block 502) as shown by the combination of FIGS. 7A and 7B (e.g., FIG. 7A showing the spacer apparatus 16 not inserted and FIG. 7B showing the spacer apparatus inserted). In one embodiment, only a primary spacer component 52 is inserted within the plurality of bristles 22 to provide reservoir 38 (e.g., an extension spacer component is inserted later as described herein). However, variation of such process steps may occur depending on the components used. The spacer apparatus 16 (e.g., primary spacer component 52 and extension component 54) defines the opening 18 extending through the spacer apparatus 16 from the proximal end to a distal end thereof.

Still further as shown in FIG. 8, a mandrel 84 (or other shaping or processing device) is inserted into the proximal end 126 of the ferrule 20 to configure the plurality of bristles 22 (block 503) (e.g., pack the bristles). The mandrel 84 may be of any suitable configuration for accomplishing one or more functions. For example, as shown in FIG. 7A, the mandrel 84 includes a base 85 and a position member 86 extending from the base 85 and terminating in a shaping region 87. The position member 86 may provide for the desired positioning of the spacer apparatus 16 within the ferrule 20 as well as the shape of the bristles 22 at the distal bristle end region 122. For example, the shape of shaping region 87 terminating the position member 84 and at the perimeter thereof configures the bristles at the proximal bristle end region 123 such that the bristles 22 at the distal bristle end region 122 have a particular shape (e.g., with the shaping region 87 as shown in FIG. 7A, the bristles 22 at the distal bristle end region 122 will have rounded edges at the perimeter edge of the bristles). The plurality of spacing elements 57 of the spacer apparatus 16 may be angled to mate with the shaping region 87 of the mandrel 84 to assist in packing and shaping the bristles 22. The desired positioning of the spacer apparatus 16 within the ferrule 20 provides for the creation of the channel 147 as described herein in which the adhesive 141 is provided (e.g., wherein the proximal end 116 of the spacer apparatus 16 is located closer to the handle portion 30 of the brush handle 14 than the proximal bristle end region 123). As shown in FIG. 7C, the base 85 comes into contact with the proximal end 126 of the ferrule 20 with the position member 86 of the mandrel 84 extending into the ferrule 20 to accomplish the desirable configuration of the bristles 22 and spacer apparatus 16.

In one embodiment of the method 500, as shown by block 504, with the mandrel 84 removed (as shown in FIG. 7D which does not show the bristles 22), the extension spacer component 54 may be inserted into place and coupled to the primary spacer component 52, such as with adhesive or in any other manner (as shown in FIG. 7E which also does not show the bristles) to provide a lengthened spacer apparatus 16 along axis 15 (as well as a lengthened opening 18 therethrough) positioned in the ferrule 20. One will recognize that such components may be provided as a single component in certain configurations and the use of an extension component may not be needed in the manufacturing process, and may not be a part of a spacer apparatus in one or more brush configurations.

Further, the method 500 includes providing adhesive 141 in a bristle region 133 defined between the spacer apparatus 16 and the ferrule 20 to couple at least a portion of the plurality of bristles 22 at the proximal bristle end region 123 to the spacer apparatus 16 and the ferrule 20 (block 505). For example, in at least one embodiment, as shown in FIG. 5B, the adhesive 141 is provided in the channel 147 described herein created between the spacer apparatus 16 and the ferrule 20 and the adhesive 141 is sufficiently flowable to provide self-leveling therein (e.g., the adhesive may be provided in the channel in any manner, such as with use of a nozzle). Further, for example, in one embodiment, the adhesive 141 may be provided in the bristle region 133 about the entire perimeter of the spacer apparatus 16 between one or more outer surfaces 162 of the spacer apparatus 16 and at least one inner surface 170 of the ferrule 20. It will be recognized that the entire spacer apparatus 16 is not embedded in the adhesive 141 as the proximal end 116 thereof must be open to allow fluid to flow therein. In other words, at least a portion of the proximal end 116 of the spacer apparatus 16 used to create the at least one reservoir 38 in the bristles is free of adhesive.

Thereafter, a brush handle is provided and coupled to the ferrule 20 of bristle portion 12 (block 506). For example, the brush handle 14 may include a handle portion 30 and an attachment portion 32, wherein the attachment portion 32 defines at least one channel 40 extending from a distal outlet opening 42 to a proximal inlet opening 44 located closer to the handle portion than the distal outlet opening. The attachment portion 32 of the brush handle 14 may be coupled to the ferrule 20 such that the at least one channel 40 of the attachment portion 32 and the at least one opening 18 of the spacer apparatus 16 define a passageway that allows fluid passage from the proximal inlet opening 44 of the attachment portion 32 to the at least one reservoir 38 to assist in removal of paint from the bristles 22 when fluid is provided into the proximal inlet opening 44. Still further, the brush handle may be a removable handle (e.g., without a channel 40 being defined therein) such as, for example, in a configuration where the bristle portion 12 is removable from the brush handle 14 for cleaning purposes.

Illustrative embodiments of this invention are discussed and reference has been made to possible variations within the scope of this invention. These and other variations, combinations, and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

The invention claimed is:

1. A paint brush comprising:

a brush handle comprising a handle portion and an attachment portion, wherein the attachment portion defines at least one channel extending from a distal outlet opening to a proximal inlet opening located closer to the handle portion than the distal outlet opening;

a plurality of bristles extending from a distal bristle end region to a proximal bristle end region;

a ferrule extending around and in contact with at least a portion of the plurality of bristles at the proximal bristle end region; and a spacer apparatus extending along an axis from a proximal end to a distal end and positioned to space apart the plurality of bristles at the proximal bristle end region to provide a single reservoir within the plurality of bristles proximate the distal end of the spacer apparatus, wherein the spacer apparatus defines a single narrow unobstructed opening extending along the axis through the spacer apparatus from the proximal end to the distal end that is elongated in a direction orthogonal to the axis, wherein the paint brush has a maximum width orthogonal to the axis, and further wherein the single narrow unobstructed opening defined by the spacer apparatus has a length in the direction orthogonal to the axis that is at least 30% of the maximum width of the paint brush, wherein at least a portion of the plurality of bristles at the proximal bristle end region are coupled between the ferrule and the spacer apparatus, and further wherein the at least one channel of the attachment portion and the single narrow unobstructed opening of the spacer apparatus define a passageway that allows fluid passage from the proximal inlet opening of the attachment portion to the single reservoir to assist in removal of paint from the plurality of bristles when fluid is provided into the proximal inlet opening of the attachment portion.

2. A paint brush comprising:

a plurality of bristles extending from a distal bristle end region to a proximal bristle end region;

a ferrule extending between a proximal end and a distal end, the ferrule extending around and in contact with at least a portion of the plurality of bristles at the proximal bristle end region;

a spacer apparatus extending along an axis from a proximal end to a distal end and positioned to space apart the plurality of bristles at the proximal bristle end region to provide a single reservoir within the plurality of bristles proximate the distal end of the spacer apparatus, wherein the spacer apparatus defines a single narrow unobstructed opening extending along the axis through the spacer apparatus from the proximal end to the distal end that is elongated in a direction orthogonal to the axis, wherein the paint brush has a maximum width orthogonal to the axis, and further wherein the single narrow unobstructed opening defined by the spacer apparatus has a length in the direction orthogonal to the axis that is at least 30% of the maximum width of the paint brush, wherein at least a portion of the plurality of bristles at the proximal bristle end region are coupled between the ferrule and the spacer apparatus, and further wherein the single narrow unobstructed opening of the spacer apparatus defines a passageway that allows fluid passage therethrough to the single reservoir to assist in removal of paint from the plurality of bristles when fluid is provided therein; and a brush handle attachable at the proximal end of the ferrule.

3. The paint brush of claim 2, wherein the brush handle comprises a handle portion and an attachment portion, wherein the attachment portion defines at least one channel extending from a distal outlet opening to a proximal inlet opening located closer to the handle portion than the distal outlet opening, and further wherein the attachment portion of the brush handle and the ferrule are coupled such that the at least one channel of the attachment portion and the single narrow unobstructed opening of the spacer apparatus define a passageway that allows fluid passage from the proximal inlet opening of the attachment portion to the single reservoir to assist in removal of paint from the bristles when fluid is provided into the proximal inlet opening.

4. The paint brush of claim 1, wherein the ferrule comprises at least one inner surface in contact with the plurality of bristles, wherein the spacer apparatus comprises one or more inner surfaces adjacent the single narrow unobstructed opening and one or more outer surfaces facing the least one inner surface of the ferrule, wherein the one or more outer surfaces of the spacer apparatus and the at least one inner surface of the ferrule define a bristle region within which the plurality of bristles are located.

5. The paint brush of claim 4, wherein an adhesive is provided in the bristle region to couple the plurality of bristles at the proximal bristle end region to the ferrule and the spacer apparatus.

6. The paint brush of claim 5, wherein the adhesive seals the bristle region about the entire perimeter of the spacer apparatus between the one or more outer surfaces of the spacer apparatus and the at least one inner surface of the ferrule.

7. The paint brush of claim 1, wherein the ferrule extends from a distal end to a proximal end, wherein the proximal end of the ferrule is located closer to the handle portion than the proximal end of the spacer apparatus, and further wherein the proximal end of the spacer apparatus is located closer to the handle portion than the proximal bristle end region.

8. The paint brush of claim 1, wherein the spacer apparatus is spaced from an inner surface of the ferrule by a plurality of spacing elements.

9. The paint brush of claim 1, wherein the ferrule comprises an inner surface in contact with the plurality of bristles, wherein a plurality of grooves are defined in the inner surface.

10. The paint brush of claim 1, wherein the ferrule comprises a seamless ferrule.

11. The paint brush of claim 1, wherein the single narrow unobstructed opening of the spacer apparatus is configured to restrict the ingress of paint from the single reservoir into the at least one channel.

12. A paint brush comprising:

a brush handle comprising a handle portion and an attachment portion, wherein the attachment portion defines at least one channel extending from a distal outlet opening to a proximal inlet opening located closer to the handle portion than the distal outlet opening;

a plurality of bristles extending from a distal bristle end region to a proximal bristle end region;

a ferrule extending around and in contact with at least a portion of the plurality of bristles at the proximal bristle end region;

a spacer apparatus extending from a proximal end to a distal end and positioned to space apart the plurality of bristles at the proximal bristle end region to provide at least one reservoir within the plurality of bristles, wherein the spacer apparatus defines at least one opening extending through the spacer apparatus from the proximal end to the distal end, wherein at least a portion of the plurality of bristles at the proximal bristle end region are coupled between the ferrule and the spacer apparatus, and further wherein the at least one channel of the attachment portion and the at least one opening of the spacer apparatus define a passageway that allows fluid passage from the proximal inlet opening of the attachment portion to the at least one reservoir to assist in removal of paint from the plurality of bristles when fluid is provided into the proximal inlet opening of the attachment portion; and a plug portion configured to extend into the at least one opening of the spacer apparatus to selectably close the proximal inlet opening and remove material in the at least one opening when positioned therein.

13. The paint brush of claim 1, wherein the handle portion defines a void region proximate the proximal inlet opening to allow access thereto.

14. The paint brush of claim 13, wherein the handle portion comprises:

an elongated handle member extending between a proximal end and a distal end; and further comprises one of:

first and second spaced apart arm members coupling the distal end of the elongated handle member to first and second spaced apart portions of the attachment member, wherein the void region is located between the first and second spaced apart members;

a solid material handle body member extending from and coupling the distal end of the elongated handle member to and along a width of the attachment member, wherein the void region is located on at least one side of the solid material handle body member; or a single curved arm member coupling the distal end of the elongated handle member to a portion of the attachment member, wherein the void region is located between the proximal inlet opening and a portion of the single curved arm member.

15. The paint brush of claim 1, wherein the attachment portion defines a narrow channel extending along an axis from the distal outlet opening to the proximal inlet opening that is elongated in a direction orthogonal to the axis, and further wherein the narrow channel defined by the attachment member has a length in the direction orthogonal to the axis that is at least 30% of the maximum width of the paint brush.

16. A method of manufacturing a paint brush, wherein the method comprises:

providing a plurality of bristles extending from a distal bristle end region to a proximal bristle end region;

providing a ferrule extending from a proximal end to a distal end, wherein the ferrule defines a bristle opening;

locating the plurality of bristles into the bristle opening of the ferrule;

inserting a spacer apparatus which extends along an axis from a proximal end to a distal end thereof within the proximal bristle end region of the plurality of bristles to space apart at least a portion of the plurality of bristles to provide a single reservoir within the plurality of bristles proximate the distal end of the spacer apparatus, wherein the spacer apparatus defines a single narrow unobstructed opening extending along the axis through the spacer apparatus from the proximal end to the distal end that is elongated in a direction orthogonal to the axis, wherein the paint brush has a maximum width orthogonal to the axis, and further wherein the single narrow unobstructed opening defined by the spacer apparatus has a length in the direction orthogonal to the axis that is at least 30% of the maximum width of the paint brush;

inserting a mandrel into the proximal end of the ferrule to configure the plurality of bristles;

providing adhesive in a bristle region defined between the spacer apparatus and the ferrule to couple at least a portion of the plurality of bristles at the proximal bristle end region to the spacer apparatus and the ferrule;

providing a brush handle comprising a handle portion and an attachment portion, wherein the attachment portion defines at least one channel extending from a distal outlet opening to a proximal inlet opening located closer to the handle portion than the distal outlet opening; and coupling the attachment portion of the brush handle and the ferrule such that the at least one channel of the attachment portion and the single narrow unobstructed opening of the spacer apparatus define a passageway that allows fluid passage from the proximal inlet opening of the attachment portion to the single reservoir to assist in removal of paint from the bristles when fluid is provided into the proximal inlet opening.

17. The method of claim 16, wherein providing adhesive in the bristle region comprises providing adhesive in the bristle region about the entire perimeter of the spacer apparatus between one or more outer surfaces of the spacer apparatus and at least one inner surface of the ferrule.

18. The method of claim 16, wherein inserting the mandrel into the proximal end of the ferrule comprises positioning the spacer apparatus such that the proximal end of the ferrule is located closer to the handle portion than the proximal end of the spacer apparatus and the proximal end of the spacer apparatus is located closer to the handle portion than the proximal bristle end region to create a channel for receiving the adhesive between the spacer apparatus and an inner surface of the ferrule.

19. The method of claim 16, wherein inserting the spacer apparatus comprises using a plurality of spacing elements to space the spacer apparatus from an inner surface of the ferrule.

* * * * *